343-700 MS AU 256 EX
12/26/78 OR 4,131,892

United States Patent [19]
Munson et al.

[11] 4,131,892
[45] Dec. 26, 1978

[54] STACKED ANTENNA STRUCTURE FOR RADIATION OF ORTHOGONALLY POLARIZED SIGNALS

[75] Inventors: Robert E. Munson; Gary G. Sanford, both of Boulder; Lawrence R. Murphy, Longmont, all of Colo.

[73] Assignee: Ball Corporation, Muncie, Ind.

[21] Appl. No.: 783,542

[22] Filed: Apr. 1, 1977

[51] Int. Cl.[2] ..... H01Q 13/10; H01Q 1/42; H01Q 00/00

[52] U.S. Cl. ..... 343/700 MS; 343/770; 343/789

[58] Field of Search ..... 343/700 MS, 705, 708, 343/768, 770, 771, 756, 789, 846

[56] References Cited

U.S. PATENT DOCUMENTS

| | | | |
|---|---|---|---|
| 2,684,444 | 7/1954 | Fales | 343/770 |
| 3,478,362 | 11/1969 | Ricardi et al. | 343/700 MS |
| 3,823,404 | 7/1974 | Buie, Jr. | 343/770 |
| 4,051,477 | 9/1977 | Murphy et al. | 343/700 MS |

FOREIGN PATENT DOCUMENTS

| | | | |
|---|---|---|---|
| 629893 | 9/1949 | United Kingdom | 343/771 |

*Primary Examiner*—Alfred E. Smith
*Assistant Examiner*—Harry Barlow
*Attorney, Agent, or Firm*—J. David Haynes

[57] ABSTRACT

A resonant circularly or elliptically polarized microstrip radiator wherein the size of the radiator is reduced in the resonant or non-resonant dimensions, or both, without reducing the effective resonant dimension or substantially lowering the efficiency of the radiator. Reduction of the resonant dimension is provided by folding the resonant cavity, while reduction of the non-resonant dimension is facilitated by utilization of a low density, low loss dielectric, such that the loss resistance of the element is appreciable with respect to the radiation resistance of the element. The preferred embodiment comprises interdigitated antenna structures.

21 Claims, 5 Drawing Figures

Figure 3:
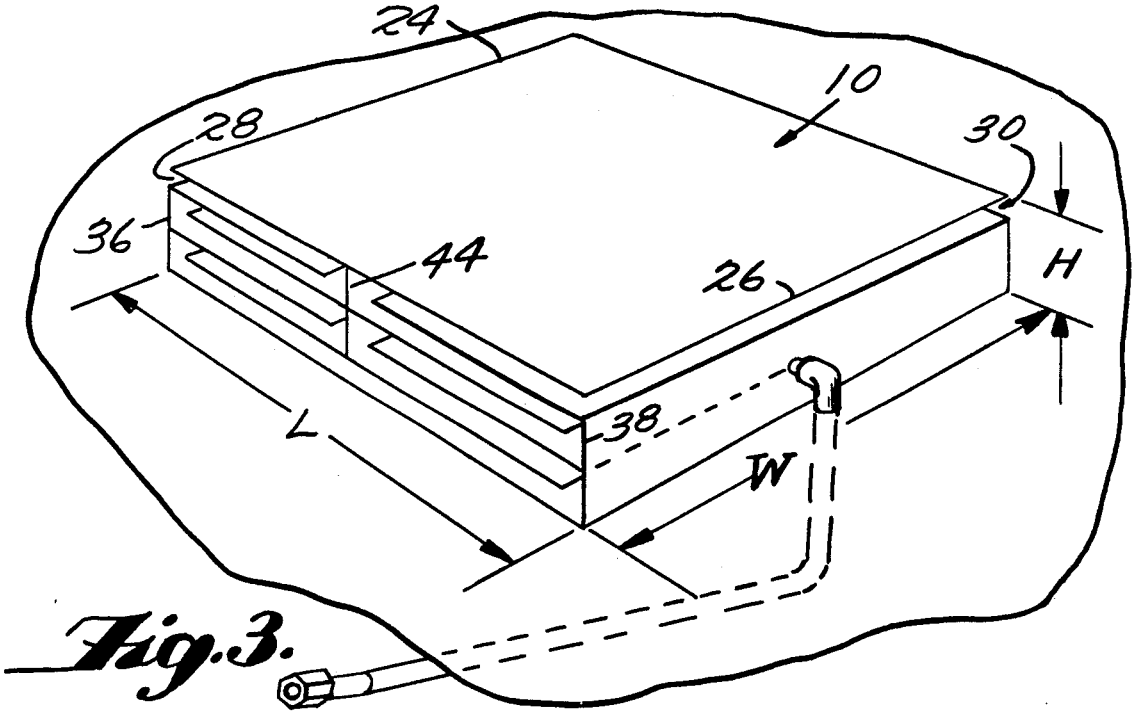

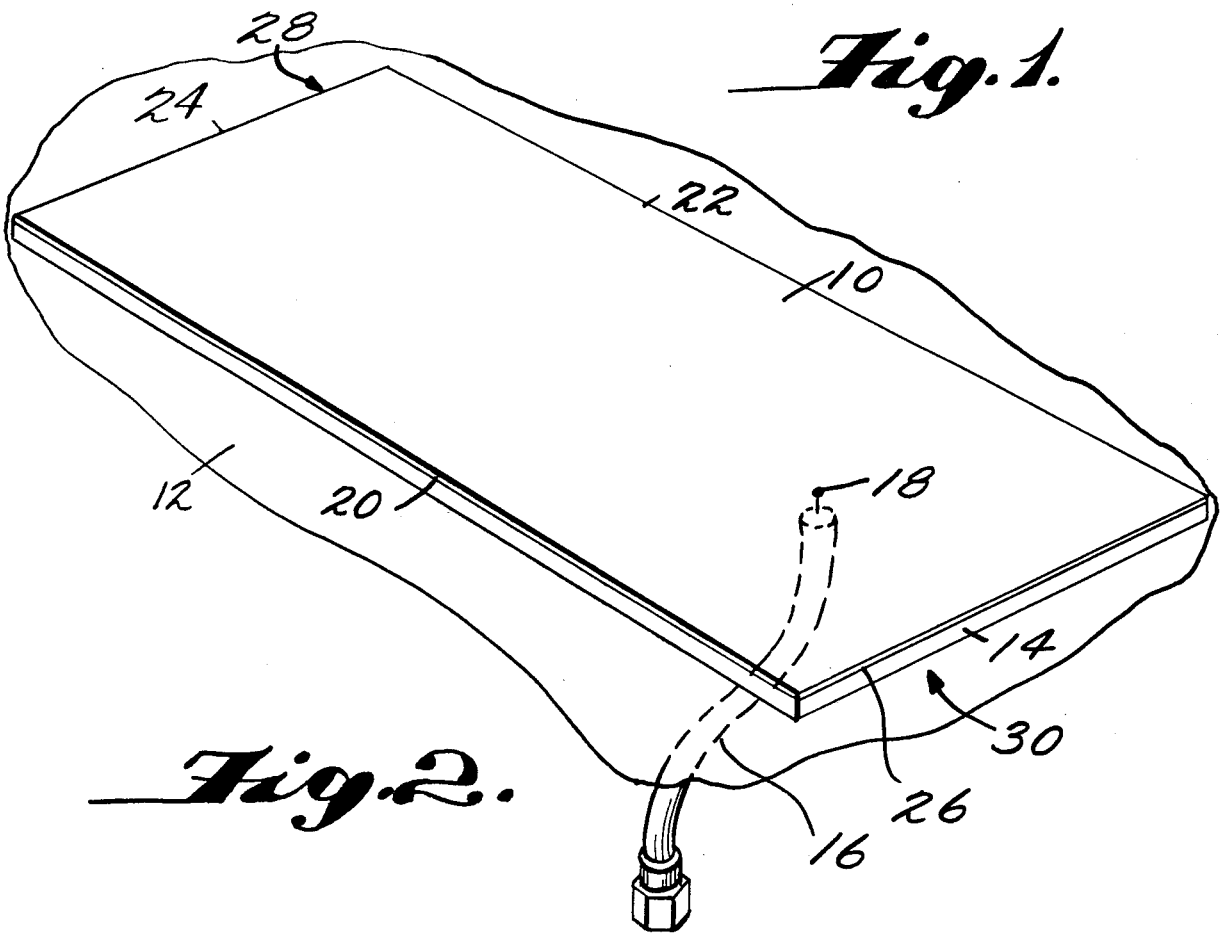
Fig. 1.
Fig. 2.
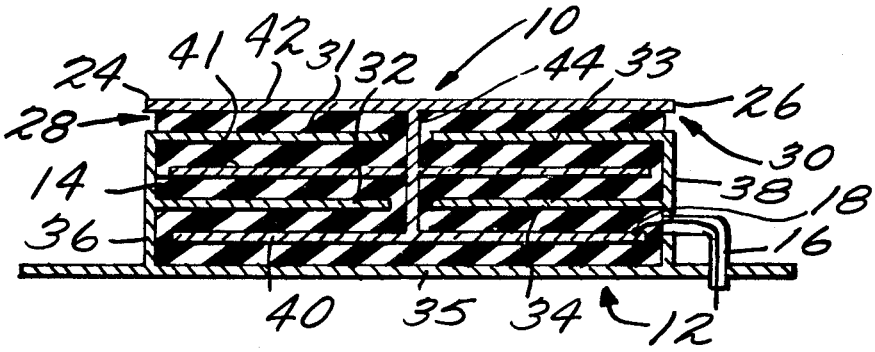
Fig. 4.
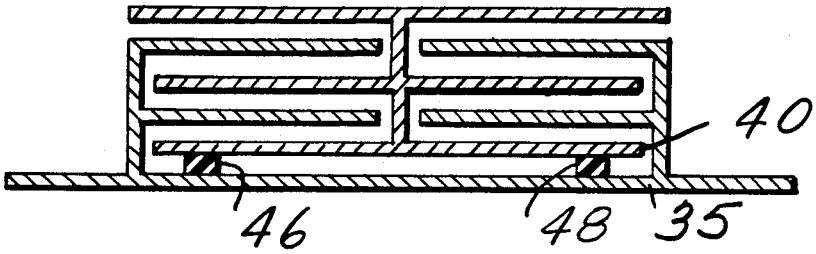

STACKED ANTENNA STRUCTURE FOR RADIATION OF ORTHOGONALLY POLARIZED SIGNALS

SPECIFICATION

The present invention relates to radio frequency antenna structures and more specifically to resonant microstrip radiator elements. The generic type of radiator employed in this invention is claimed in a related commonly assigned copending application Ser. No. 783,541 filed concurrently herewith in the names of R. E. Munson and G. G. Sanford.

In general, microstrip radiators are specially shaped and dimensioned conductive surfaces formed on one surface of a planar dielectric substrate, the other surface of such substrate having formed thereon a further conductive surface commonly termed the "ground plane". Microstrip radiators are typically formed, either singly or in an array, by conventional photoetching processes from a dielectric sheet laminated between two conductive sheets. The planar dimensions of the radiating element are chosen such that one dimension is on the order of a predetermined portion of the wavelength of a predetermined frequency signal within the dielectric substrate, and the thickness of the dielectric substrate chosen to be a small fraction of the wavelength. A resonant cavity is thus formed between the radiating element and ground plane, with the edges of the radiating element in the non-resonant dimension defining radiating slot apertures between the radiating element edge and the underlying ground plane surface. For descriptions of various microstrip radiator structures, reference is made to U.S. Pat. Nos. 3,713,162, issued Jan. 23, 1973 to R. Munson et al.; 3,810,183, issued May 7, 1974 to J. Krutsinger et al.; and 3,811,128 and 3,921,177, respectively, issued on May 7, 1974 and on Nov. 18, 1975 to R. Munson and also to copending applications Ser. Nos. 707,418, filed Aug. 25, 1975 by R. Munson; 596,263, filed July 16, 1975 by J. Krutsinger et al.; 620,196 and 683,203, filed Oct. 6, 1975 and May 4, 1976, respectively, by G. Sanford; 658,534, filed Feb. 17, 1976 by L. Murphy; 666,174, filed Mar. 12, 1976 by R. Munson et al.; 723,643, filed Sept. 15, 1976 by M. Alspaugh et al., and 759,856, filed Jan. 1, 1977 by G. Sanford et al. — all commonly assigned with the present invention to Ball Corporation.

A dilemma arises in the prior art with respect to constraints on the minimum size of antenna elements. By definition, the effective resonant dimension of the resonant cavity, defined by the radiating element (commonly called the "E-plane dimension") must be approximately a predetermined portion of a wavelength of the operating frequency signal in the dielectric. The prior art has generally attempted to reduce the size of the antenna elements by utilizing substrates with high dielectric constants to, in effect, reduce the wavelength of the resonant frequency within the dielectric substrate and thereby allow for a smaller resonant dimension. Such an approach, however, is disadvantageous in that the use of a high dielectric substrate increases the loss conductance of the cavity and results in a larger non-resonant dimension, as will be explained, or significantly lower efficiency of the antenna or both.

The non-resonant dimension, commonly termed the "H-plane dimension", is determined in major part by the beam width and efficiency of the antenna. The efficiency of the antenna is typically expressed as a ratio of the power actually radiated to the power input, where the power input is (neglecting any reflected components) substantially equal to the sum of the power radiated and the power loss through heat dissipation in the dielectric. The equivalent circuit of the antenna element, with respect to power dissipation, may be expressed as a parallel combination of a radiation resistance and a dielectric loss resistance where the radiation and dielectric loss resistances are respectively defined as the resistances which, when placed in series with the antenna element, would dissipate the same amount of power as actually radiated by the element and as dissipated by the dielectric, respectively. The radiation power and dielectric loss are thus inversely proportional to the respective values of the radiation and loss resistances. The radiation resistance, however, is inversely proportional to the non-resonant dimension of the element. For a given dielectric, a required efficiency therefore prescribes the minimum non-resonant dimension of the element. Thus, conflicting criteria for reducing the respective dimensions of an antenna element existed in the prior art, in that the required effective resonant dimension of the element is determined by the wavelength of the resonant frequency signal in the dielectric and substrates having high dielectric constant to reduce such wavelength typically present a low loss resistance, requiring, therefore, a wider non-resonant dimension.

It should be appreciated that minimum size constraints can cause significant problems in applications where a large multiplicity of radiating elements are required, but limited space is available for antenna area, for example, a communication system antenna for use on an astronaut's backpack.

The present invention provides for a radiating element of reduced planar size without significantly decreasing the efficiency of the element, reducing the minimum non-resonant dimension by utilizing a low density, low loss dielectric substrate, and reducing the actual resonant dimension, while maintaining the effective resonant dimension at approximately a predetermined portion of a wavelength of the operating frequency in the dielectric by folding the resonant cavity.

Figure 5:
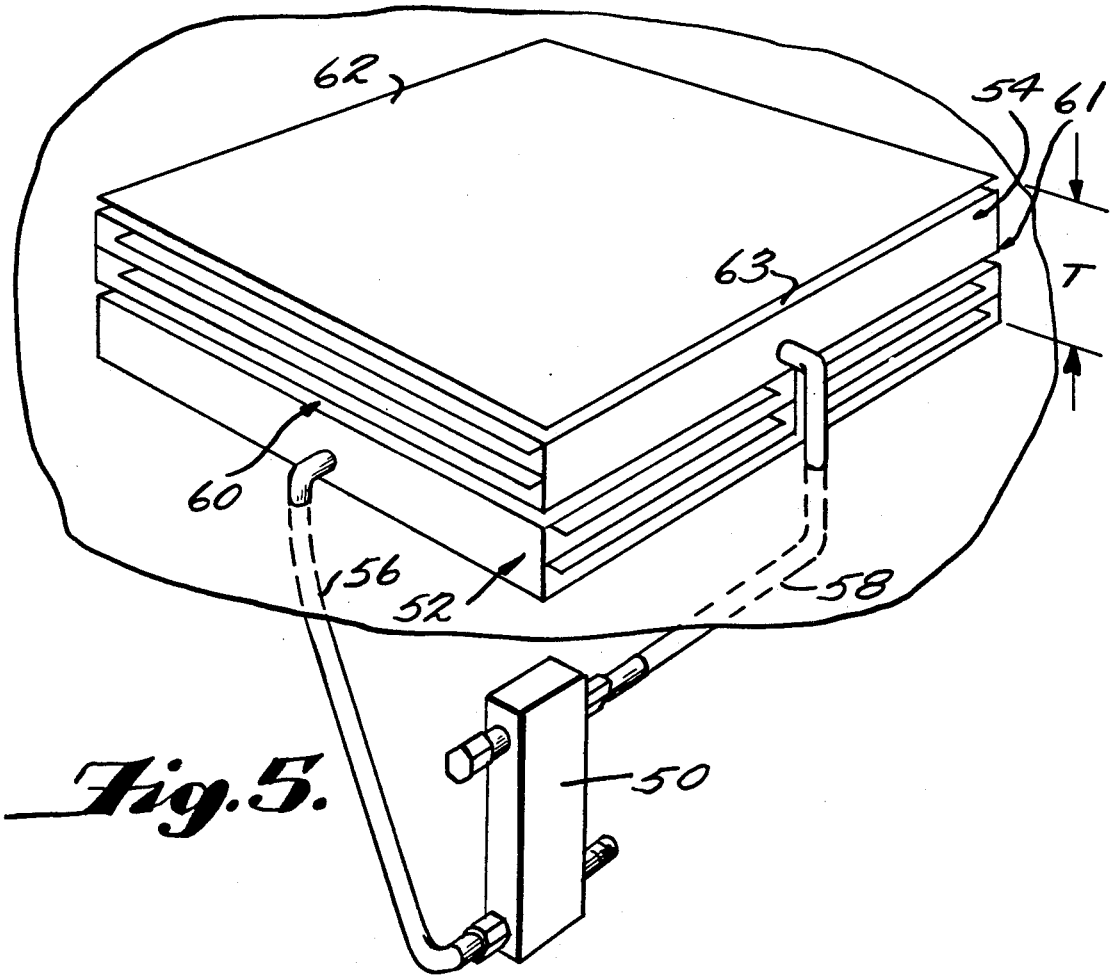

A description of the preferred embodiment follows with reference to the accompanying drawing, wherein like numerals denote like elements, and:

FIG. 1 is a perspective view of a microstrip radiating element with narrowed non-resonant dimension;

FIGS. 2 and 3, respectively, are sectional and perspective views of a folded microstrip radiating element;

FIG. 4 is a sectional view of an interdigitated antenna structure utilizing standoffs; and FIG. 5 shows a microstrip radiator in accordance with one aspect of the present invention adapted to radiate circularly polarized signals.

With reference to FIG. 1, a planar conductive radiating element 10 is insulated from a conductive ground plane 12, disposed parallel thereto, by a dielectric substrate 14. Signals of a predetermined operating frequency are applied to radiating element 10 and ground plane 12, for example, by a coaxial cable 16. Coaxial cable 16 is preferably coupled to radiating element 10 at a point 18 where the impedance of element 10 matches the impedance (typically 50 ohms) of the cable. Radiating element 10 is generally rectangular, having planar dimensions such that one set of edges 20 and 22 defines a resonant dimension approximately equal to one-half of the wavelength of the predetermined frequency signal in dielectric substrate 14, for example, 0.45 of the free space wavelength of the signal. Dielectric substrate 14 is a fraction of a wavelength, for example, 0.002 times the free space wavelength of the resonant frequency. A resonant cavity is formed between radiating element 10 and ground plane 12 with radiation emanating from radiating aperture slots 28 and 30 formed between edges 24 and 26 and ground plane 12.

Dielectric substrate 14 is preferably a low density, low loss expanded dielectric substance such as a honeycombed or foamed structure as described in the aforementioned copending application, Ser. No. 666,174, "High Efficiency, Low Weight Antenna", filed March 12, 1976 by R. Munson and G. Sanford. Briefly, such expanded dielectric comprises, in substantial portion, voids to provide a rigid, low weight, low density, low loss structure. Expanded dielectrics, however, typically present a lower dielectric constant than non-expanded dielectric substrates, such as teflon-fiberglass typically used in the prior art. Thus, use of an expanded dielectric generally requires an elongation of the effective resonant dimension. However, the present inventors have discovered that the loss resistance of such expanded dielectric substrate is far greater than the loss resistance of non-expanded dielectric substrate, providing for a reduction in the minimum non-resonant dimension, substantially exceeding the increase in the resonant dimension required due to decreased dielectric constant. For example, the non-resonant dimension can be chosen to be 0.1 times the free space wavelength of the applied signal, as compared with 0.3–0.9 times the free space wavelength typical for the prior art. Thus, in accordance with one aspect of the present invention, a radiating element of reduced planar area can be constructed by utilizing an expanded dielectric substrate, and narrowing the non-resonant dimension. For example, a radiator of given efficiency utilizing a teflon-fiberglass substrate is 0.15 times the square of the free space wavelength, while a typical radiating element of such efficiency utilizing an expanded dielectric substrate and narrowed non-resonant dimension in accordance with the present invention is 0.05 times the square of the free space wavelength, a reduction in area by a factor on the order of 3.

The planar area of a radiating element can be further reduced in accordance with the present invention by, in effect, folding the resonant cavity. For example, the cavity can be folded along one or more axes perpendicular to the resonant dimension to create a tiered or layered structure. Alternately, a reduction in the planar size of the resonant cavity can be effected by folding or bending the microstrip into, for example, a "V" or "U" shape. FIGS. 2 and 3 depict an antenna wherein and interdigitated structure is utilized to effect a folded resonant cavity. Referring to FIGS. 2 and 3, generally ground plane 12 includes a plurality of longitudinally disposed planar conductive sheet sections 31–35 electrically connected by vertical side members 36 and 38. Radiating element 10 comprises a plurality of generally planar, longitudinally disposed conductive sheets 40–42 disposed in an interdigitated manner with respect to ground plane sections 31–35 separated therefrom by dielectric 14, and electrically connected by a vertical member 44, disposed parallel to side members 36 and 38. Apertures 28 and 30 are defined by the vertical most edges of radiating element 10. The cumulative distance from aperture 28 to aperture 30, through dielectric 14, is approximately equal to one-half wavelength of the operative frequency within the dielectric. Thus, radiating element 10 and ground plane 12 define a resonant cavity having radiating slot apertures 28 and 30 defined by edges 24 and 26 of radiating element 10 on opposite longitudinal sides of the antenna structure.

Such an interdigitated structure is, in effect, a planar microstrip element, for example such as shown in FIG. 1, folded from each end toward the middle, then folded again back toward the end along axes perpendicular to the resonant dimension and parallel to radiating apertures 28 and 30, such folding sequence repeated four times to provide a five tiered structure. It should be appreciated that interdigitated structures may be utilized to provide resonant cavities folded along a greater or lesser number of axes, with axes not necessarily parallel to the radiating aperture not perpendicular to the resonant dimension. While is it not necessary, it is preferred that an odd number of tiers be effected such that the apertures are on opposite longitudinal sides of the antenna structure.

An input signal is applied to the radiating element via coaxial cable 16, with the center conductor connected to radiating element 10 at a point 18 of appropriate impedance. While cable 16 is shown coupled through the side of the antenna element in FIGS. 2 and 3, it should be appreciated that connection can be made in any appropriate manner such as, for example, through the bottom of ground plane 12 or from the resonant dimension side.

The planar length (L) of a five-tiered interdigitated structure, such as shown in FIGS. 2 and 3 having a non-resonant dimension (W) on the order of 0.1 times the free space wavelength of the operating frequency, is also on the order of 0.1 times the free space wavelength, as opposed to 0.45 times the free space wavelength typical in a non-folded structure such as shown in FIG. 1. The height or thickness (H) of the interdigitated structure is on the order of 0.01 times the free space wavelength, as opposed to 0.002 times the free space wavelength in the unfolded element.

It should be appreciated that, while FIGS. 2 and 3 show an interdigitated structure wherein both of the side members are formed by ground plane 12, folded resonant cavities can be effected by interdigitated structures wherein one or both of the side members are formed by radiating element 10, and by interdigitated structures wherein a plurality of vertically disposed conductive elements are connected by longitudinally disposed members. Further, the conductive sheets need not be planar, but can be curved, nor need all the conductive sheets be of the same planar size. Moreover, the spacing between sheets need not be uniform or constant.

It should be appreciated that dielectric 14 can comprise a void with radiating element 10 being isolated from ground plane 12 by standoffs. Such a structure is shown in FIG. 4. Non-conductive standoffs 46 and 48 are disposed between ground plane element 35 and radiator element 40, to effect spatial separation between ground plane 12 and radiating element 10. The conductive sheets of radiator 10 and ground plane 12, in an embodiment utilizing standoffs, must be rigid enough to maintain the interdigitated separation. Where a solid or honeycombed or otherwise expanded dielectric is used, the conductive sheets can be extremely thin, with the dielectric providing structural support.

The interdigitated structure depicted in FIGS. 2 and 3 is particularly advantageous in the generation of circular or elliptically polarized signals. As described in the aforementioned U.S. Pat. No. 3,921,177 issued to R. Munson, the circular or elliptical polarization is generated utilizing a flat radiating element by applying equal amplitude signals, 90° out of phase, to adjacent (intersecting), perpendicular edges of the element. Such a technique is not feasible for use with folded or interdigitated elements. To provide circular or elliptical polarization, two interdigitated or folded elements are, in effect, stacked and rotated with respect to each other by 90° as shown in FIG. 5. Quadrature signals, as generated by, for example, a quadrature hybrid 50, are applied to respective stacked elements 52 and 54 via coaxial cables 56 and 58. Due to a masking effect by the upper element, it was found desirable to utilize cavities of approximately a half wavelength, and that the cavities maintain two radiating apertures on opposite sides of the element. It should be appreciated that, where the coaxial cables are coupled through vertical sides in the non-resonant dimension of the respective elements, the coaxial cables can be routed straight downward without interfering with the operation of radiating apertures 60–63. The thickness (T) of such stacked elements are typically on the order of 0.02 times the free space wavelength of the operating frequency.

Radiating elements utilizing folded resonant cavities in accordance with the present invention have been built for operational frequency of between 259.7 MHz to 296.8 MHz. The elements constructed were interdigitated structures similar to that shown in FIGS. 2 and 3, and were stacked as shown in FIG. 5 to provide circular polarization. A radiation pattern of −10 db gain was achieved over approximately 80% spherical coverage. The physical package was 6″ × 18″ × 3″ and weighed less than 0.45 Kg. The conductive sheets were formed of aluminum 0.005–0.020 inch thick. The sheets were set in an interdigitated arrangement, furnace brazed and then sealed with tin. The structure was then set in a mold and the space between the conductive sheets filled with liquid expanding insulating resin. The resin hardened to provide rigidity.

An interdigitated antenna structure has also been constructed on a layer-by-layer approach, sandwiching a layer of honeycomb material between conductive sheets.

A seven tiered interdigitated antenna structure utilizing a dielectric comprising standoffs and a void has also been constructed. The conductive sheets were formed of brass on the order of 0.020 inch thick, and spacing between the interdigitated elements was maintained at 0.1 inch by transverse nylon screws running through the interdigitated elements.

It should be appreciated that folded cavities in accordance with the present invention can also be of lengths other than one-half wavelength. For example, quarter-wave cavities have been constructed.

What is claimed is:

1. An antenna structure for radiating two orthogonally polarized signals comprising:

a first radiating element including a first resonant cavity and at least a first radiating aperture;

a second radiating element including a second resonant cavity and at least a second radiating aperture; and means for introducing a first applied signal to said first radiating element at a predetermined frequency and for introducing a second applied signal at said predetermined frequency but 90° out of phase with respect to said first applied signal, to said second radiating element;

said first and second radiating elements being relatively disposed such that said first and second resonant cavities overlay each other and the radiating apertures thereof are relatively disposed at 90°.

2. The antenna structure of claim 1 wherein said resonant cavities are folded.

3. The antenna structure of claim 1 wherein said first and second radiating elements each comprise:

a first plurality of conductive sheets interconnected by at least a first further conductive sheet; and a second plurality of conductive sheets interconnected by at least a second further conductive sheet;

said first and second plurality of conductive sheets being disposed alternately in an overlying manner, separated by a dielectric material.

4. The antenna of claim 3 wherein said dielectric material comprises, in substantial portion, voids.

5. The antenna of claim 4 wherein said dielectric material comprises at least one non-conductive spacer separating said first and second plurality of conductive sheets, and a void.

6. The antenna of claim 1 wherein said resonant cavities are each of an effective length of approximately one-half wavelength of said applied signal.

7. The antenna structure of claim 6 wherein said resonant cavities are folded.

8. The antenna structure of claim 6 wherein said first and second radiating elements each comprise:

a first plurality of conductive sheets interconnected by at least a first further conductive sheet; and a second plurality of conductive sheets interconnected by at least a second further conductive sheet;

said first and second plurality of conductive sheets being disposed alternately in an overlying manner, separated by a dielectric material.

9. The antenna of claim 6 wherein said dielectric material comprises, in substantial portion, voids.

10. The antenna of claim 6 wherein said dielectric material comprises at least one non-conductive spacer separating said first and second plurality of conductive sheets, and a void.

11. The antenna of claim 1 wherein said dielectric material comprises, in substantial portion, voids.

12. The antenna of claim 1 wherein said dielectric material comprises at least one non-conductive spacer separating said first and second plurality of conductive sheets, and a void.

13. An antenna structure for radiating two orthogonally polarized signals comprising:

a first interdigitated structure, including first and second sets of interdigitated conductive sheets defining a first resonant cavity therebetween having a least a first radiating aperture;

a second interdigitated structure, including third and fourth sets of interdigitated conductive sheets defining a second resonant cavity therebetween, having at least a second radiating aperture;

said first and second interdigitated structures being relatively disposed in a stacked manner, said first and second apertures being orthogonally disposed with respect to each other; and means for applying a first signal at a predetermined frequency to said first interdigitated structure and a second signal at said predetermined frequency to said second interdigitated structure, said second signal being 90° out of phase with said first signal.

14. The antenna of claim 13 wherein said resonant cavities are of effective length approximately equal to one-half wavelength of said first signal.

15. The antenna of claim 13 wherein said interdigitated conductive sheets are separated by a dielectric substance comprising, in substantial part, voids.

16. The antenna of claim 13 wherein said first resonant cavity includes first and third radiating apertures disposed on opposite sides of said first interdigitated structure; and said second resonant cavity includes second and fourth radiating apertures disposed on opposite sides of said second interdigitated structure.

17. The antenna of claim 16 wherein said resonant cavities are of effective length approximately equal to one-half wavelength of said first signal.

18. The antenna of claim 17 wherein said interdigitated conductive sheets are separated by a dielectric substance comprising, in substantial part, voids.

19. The antenna of claim 18 wherein said dielectric substance comprises at least one non-conducting spacer and a void.

20. The antenna of claim 16 wherein said interdigitated conductive sheets are separated by a dielectric substance comprising, in substantial part, voids.

21. The antenna of claim 13 wherein said first and second interdigitated structures comprise first and second transverse conductive sheets, respectively, disposed transverse to said sets of interdigitated sheets, and respectively being electrically coupled to said second and fourth sets of interdigitated sheets, said first and second transverse sheets, respectively, defining exterior surfaces of said first and second interdigitated structures, said first and second transverse sheets having upper edges, respectively, defining one edge of said first and second radiating apertures, and wherein, said means for applying said first and second signals is connected to said first and second transverse sheets, and therethrough to connect with said first and third sets of interdigitated sheets, respectively.

* * * * *